United States Patent [19]

Fulponi et al.

[11] Patent Number: 5,037,330

[45] Date of Patent: Aug. 6, 1991

[54] STACKED CIRCULAR DIN CONNECTOR

[75] Inventors: John A. Fulponi; Richard N. Whyne, both of Harrisburg, Pa.

[73] Assignee: AMP Corporated, Harrisburg, Pa.

[21] Appl. No.: 620,966

[22] Filed: Nov. 30, 1990

[51] Int. Cl.[5] ..... H01R 13/648

[52] U.S. Cl. ..... 439/607; 439/540; 439/79

[58] Field of Search ..... 439/79, 80, 444, 540, 439/607, 608, 609, 610, 701

[56] References Cited

U.S. PATENT DOCUMENTS

| | | | |
|---|---|---|---|
| 4,756,695 | 7/1988 | Lane et al. | 439/610 X |
| 4,818,239 | 4/1989 | Erk | 439/55 |
| 4,820,201 | 4/1989 | Van Brunt et al. | 439/610 |
| 4,842,554 | 6/1989 | Cosmos et al. | 439/609 |
| 4,842,555 | 6/1989 | Cosmos et al. | 439/609 |
| 4,878,856 | 11/1989 | Maxwell | 439/540 |
| 4,906,199 | 3/1990 | Twomey et al. | 439/607 X |
| 4,908,335 | 3/1990 | Cosmos et al. | 439/79 |

*Primary Examiner*—Neil Abrams
*Assistant Examiner*—Khiem Nguyen
*Attorney, Agent, or Firm*—David L. Smith

[57] ABSTRACT

A shielded, stacked electrical connector assembly comprises an upper electrical connector (2) and a lower electrical connector (4) having respective insulating housings (6,8). Each housing (6,8) has cavities (18) in which are secured electrical terminals (20) having terminal legs (46 and 50) which extend from a terminal receiving face (24) of the housing (6 or 8). A one piece, insulating, connector support housing (10) comprises an upright frame (54) from which projects a connector support (86) supporting the upper connector (2), the lower connector (4) being disposed beneath the connector support (86). The terminal legs (46) of the upper connector (2) extend through notches (80,82) in terminal leg spacer plates in the frame (54). The terminal legs (50) of the terminals (20) of the lower connector (4) extend through notches (44) in a terminal leg spacer plate (42) of the housing (8) of the lower connector (4). The metal shield (12) is secured to the housings (6 and 8) of the connectors (2 and 4) and to the frame (54) by means of detentes (110,112,114 and 116) to secure the connectors (2 and 4) and the connector support housing (10) in assembled relationship.

15. Claims, 7 Drawing Sheets

STACKED CIRCULAR DIN CONNECTOR

BACKGROUND OF THE INVENTION

This invention relates to a stacked, shielded electrical connector assembly, to an insulating connector support housing for use in the assembly and to a one piece metal shield for use in the assembly.

U.S. Pat. No. A-4,818,239 and U.S. Pat. No. A-4,878,856 disclose stacked electrical connector assemblies in which two electrical connectors are supported in superposition by means of metal brackets which are secured by means of fasteners to mounting flanges of the connectors. The assemblies are not shielded. There are disclosed in U.S. Pat. No. A-4,842,554; U.S. Pat. No. A-4,842,555 and U.S. Pat. No. A-4,842,554, surface mount circular DIN electrical connectors provided with overall shielding. These connectors each comprise a substantially rectangular cross-section insulating housing which is devoid of mounting flanges and which is secured to a circuit board by means of mounting lugs depending from the shielding. It is desirable in the interest of reducing the circuit board frontage needed for mounting the plurality of such connectors on a circuit board, that the connectors should be stacked but at the same time that they should be properly shielded.

SUMMARY OF THE INVENTION

According to one aspect of the present invention, a shielded stacked electrical connector assembly comprises upper and lower superposed electrical connectors each having a substantially rectangular cross-section body having an annular recess in which projects forwardly a circular cross-section plug portion for mating with a circular cross-section externally shielded electrical socket. A one piece insulating, connector support housing has a connector support projecting horizontally therefrom and supporting the upper connector thereon. The lower connector is arranged beneath the connector support. A one piece metal shield has anchoring means engaging the housings for both the upper and lower connectors as well as the connector support housing and thereby retains the housings within the shield. The shield is apertured to allow for a respective externally shielded electrical socket to be mated with the plug portion of each connector.

Thus, although the connectors are devoid of mounting flanges, the connector support serves to maintain them in superposed relationship in cooperation with the shield, so that a unitary and rigid stacked connector assembly is thereby provided, no separate fastening means being needed to place the parts of the assembly in assembled relationship. Conveniently, the shield can be arranged so that it can be slid over the two superposed connectors and the support housing, the shield having anchoring means which securely engage the housing of the connector, as well as the support housing simply by the action of sliding the shield over the connectors and the support housing.

The support housing may be provided with terminal leg spacer plates for securing terminal legs extending downwardly from the terminals of the upper connector, so that free ends of the legs project below the assembly proper, the terminals of the lower connector also having terminal legs projecting below the assembly, so that the free ends of all the terminal legs can be inserted through respective holes in a circuit board for soldering signal conductors thereon. The shield may, of course, be connected to ground by any suitable means.

The spacing between the upper and lower connectors can be selected by appropriately dimensioning the connector support of the connector support housing.

Means may also be provided, for temporarily securing the connectors to the support housing to hold them in their correct relative positions for the assembly of the shield thereto.

According to another aspect of the invention, a one piece, insulating, electrical connector support housing for use in stacking electrical connectors in a shielded, stacked electrical connector assembly, comprises a substantially rectangular frame defined by a top wall, a bottom wall and a pair of spaced elongate side walls connecting the top and bottom walls, each side wall having a forward and a rear face. A connector support projects from the forward faces of the side walls substantially normally thereof and substantially midway between the top and bottom walls, a pair of parallel terminal leg spacer plates spanning the side walls in spaced relationship longitudinally thereof and each spacer plate having a plurality of terminal leg receiving notches opening rearwardly of the frame. A first latching shoulder is provided on each side wall, above the connector support and a second latching shoulder is provided on each side wall below the connector support. These latching shoulders serve for latching engagement with respective detentes on the metal shield as it is slid over the support housing.

For stable support of the upper connector, connector support may comprise two arms spanned by a crossbar, the crossbar having a rib on the upper face thereof. Thus where the upper connector has ribs depending from the side walls as will frequently be the case, the ribs can be placed on respective arms of the connector support, the forward part of the housing being supported on the rib.

According to a further aspect of the invention a one piece metal shield for upper and lower superposed stacked electrical connectors each having a substantially rectangular cross-section body having an annular recess within which projects a circular cross-section body plug portion for mating with a circular cross-section, externally shielded electrical socket, comprises a top wall for enclosing substantially the entirety of a top wall of the body of the upper connector. The shield also comprises a pair of shield side walls each adjacent to the shield top wall for enclosing substantially the entirety of opposite side walls of the bodies of both the upper and lower connectors. A shield front wall adjacent to the shield top wall and to the shield side walls has two substantially circular openings therein each for receiving a respective socket for mating with a respective one of the plug portions. The shield is accordingly adapted to provide shielding for substantially the entirety of the stacked connectors.

DETAILED DESCRIPTION OF AN EMBODIMENT OF THE INVENTION

Figure 1:
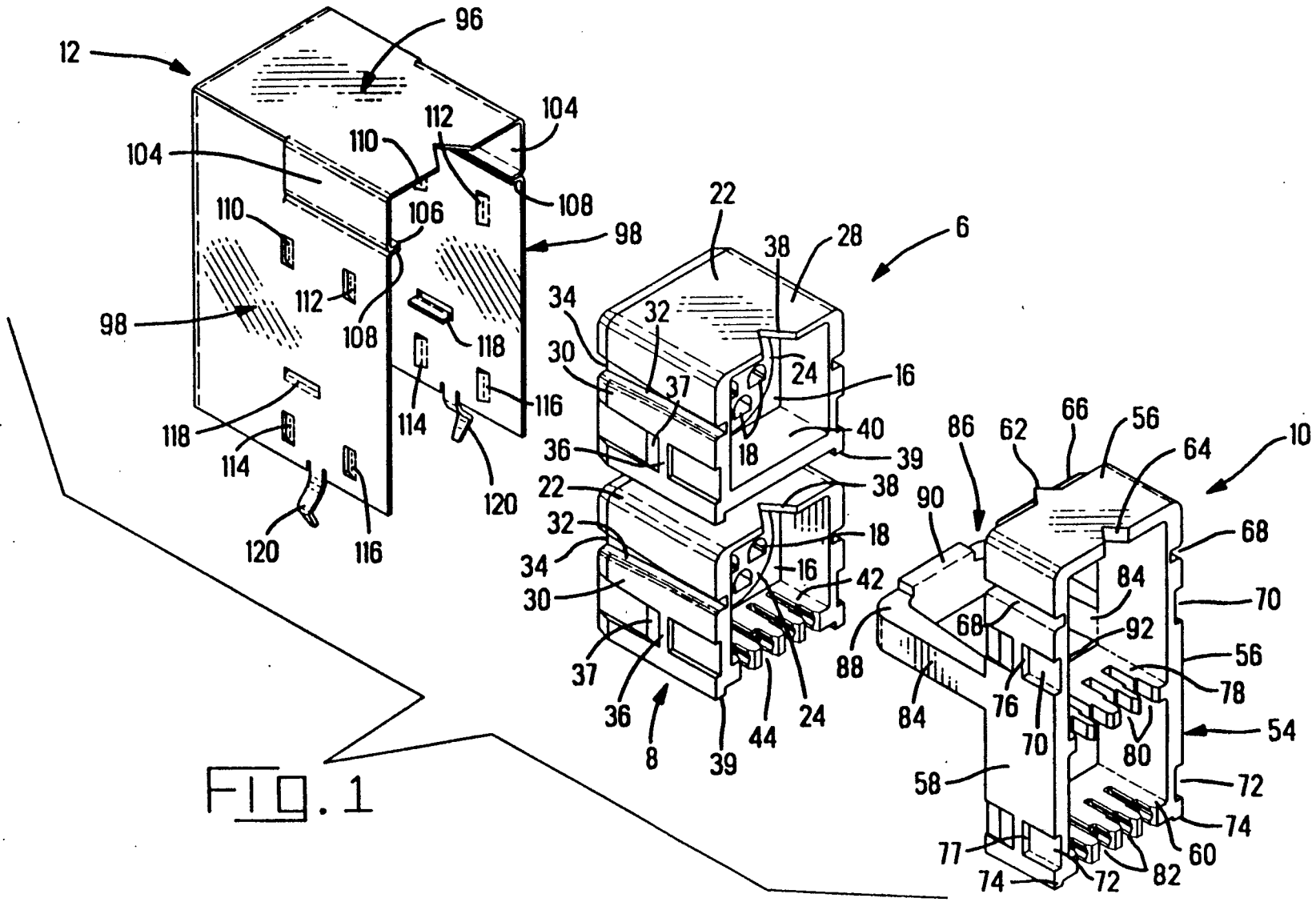
FIG. 1 is an exploded isometric view of a shielded electrical connector assembly comprising two stacked, right angle, circular DIN electrical connectors, a connector support housing and a common metal shield, electrical terminals of the connector not being shown in FIG. 1.

Reference will now be made to FIGS. 1 to 4. A shielded stacked electrical connector assembly comprises upper and lower right angle circular DIN electrical connectors 2 and 4, respectively, only the respective insulating housings 6 and 8 of which are shown in FIG. 1, the assembly further comprising a connector support insulating housing 10 and a common metal shield 12.

Figure 4:
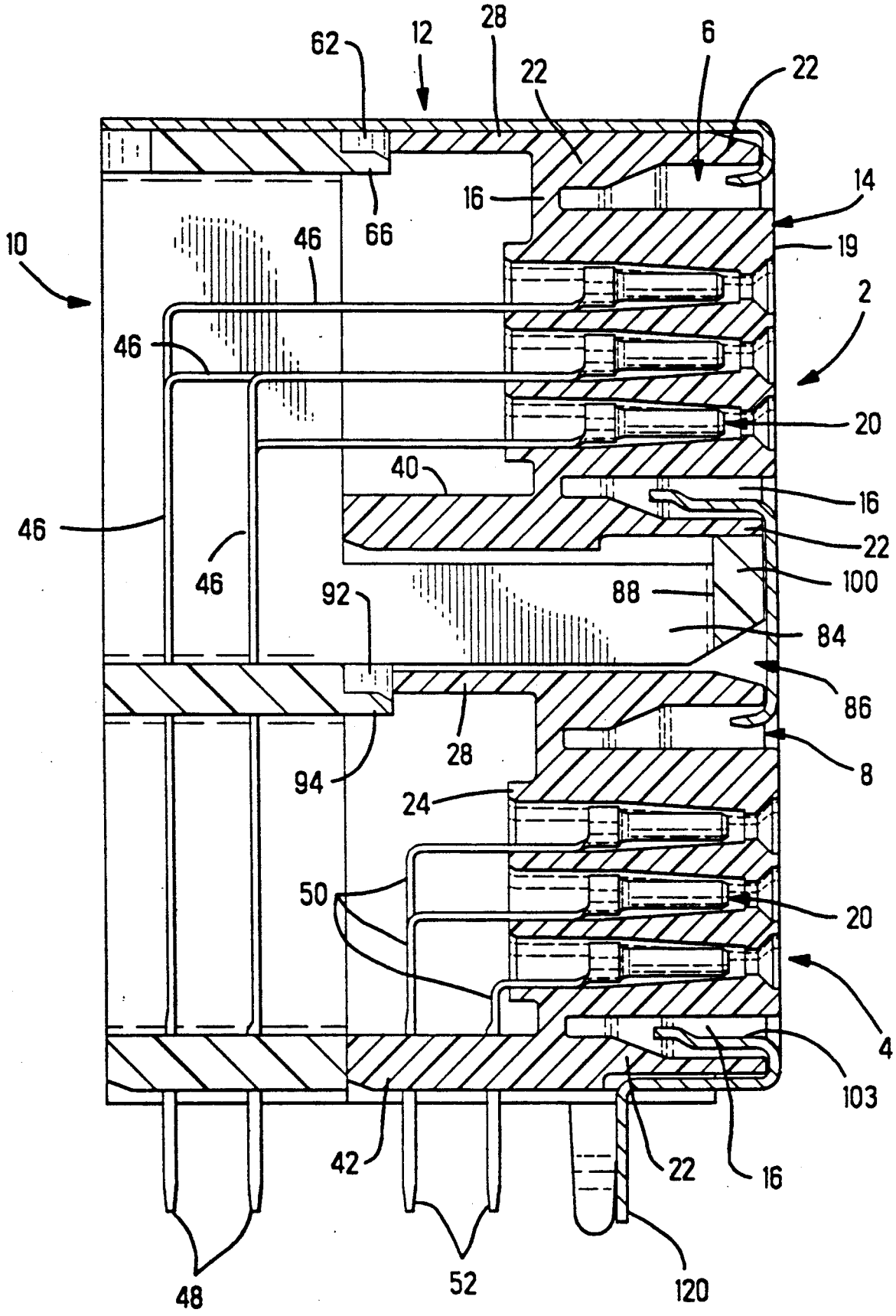
FIG. 4 is a view taken on the lines 4—4 of FIG. 3.
Figure 5:
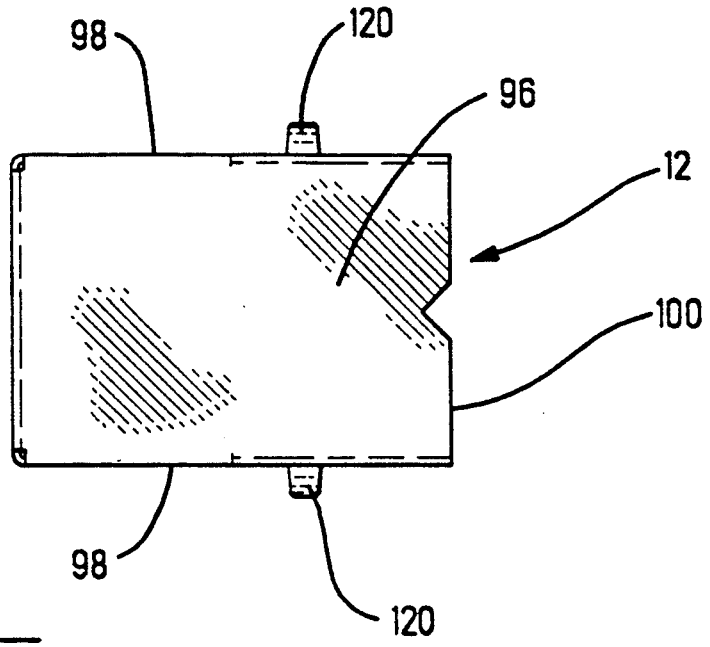
FIG. 5 is top plan view of the assembly.
Figure 6:
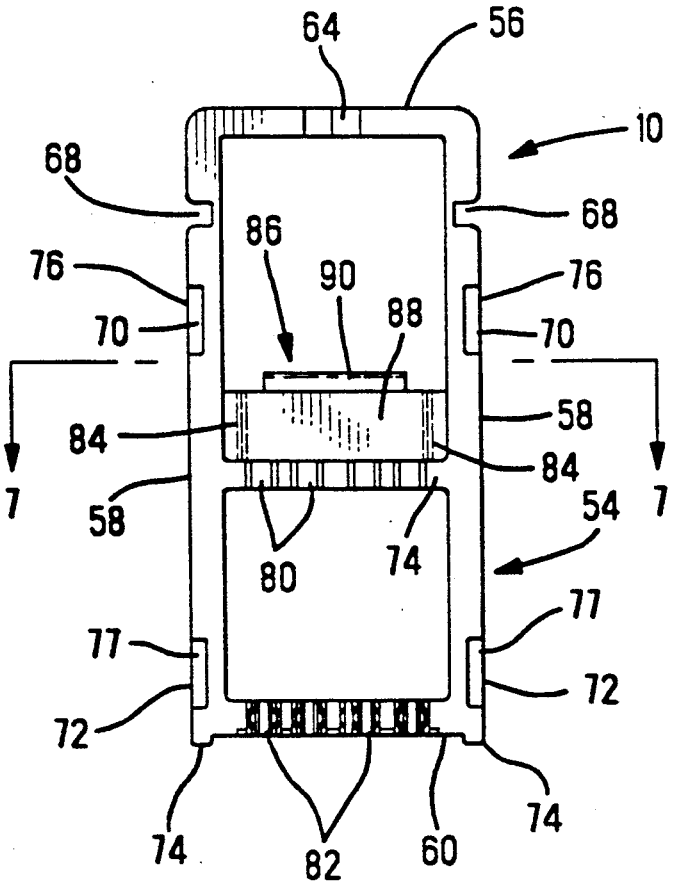
FIG. 6 is a rear end view of the support housing.
Figure 7:
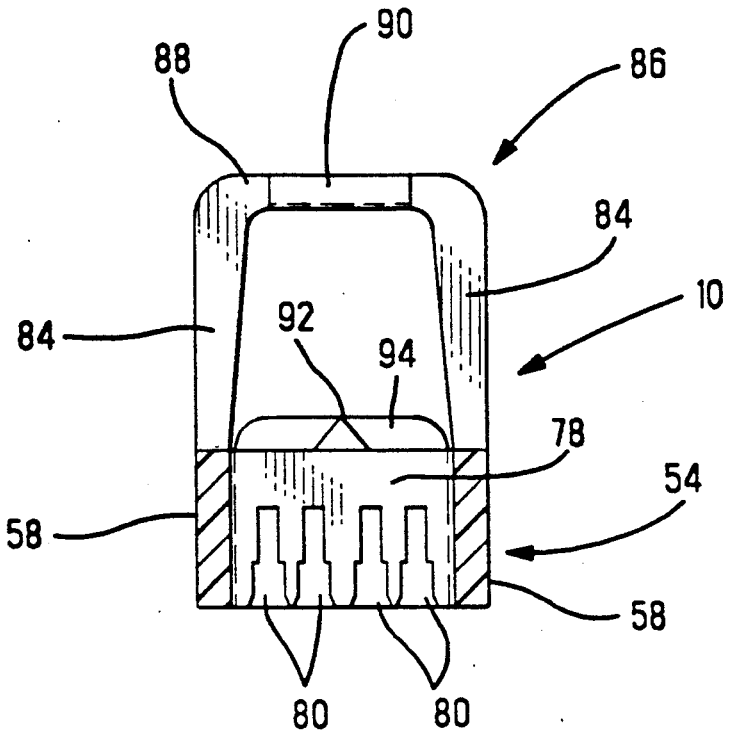
FIG. 7 is a view taken on the lines 7—7 of FIG. 6.
Figure 8:
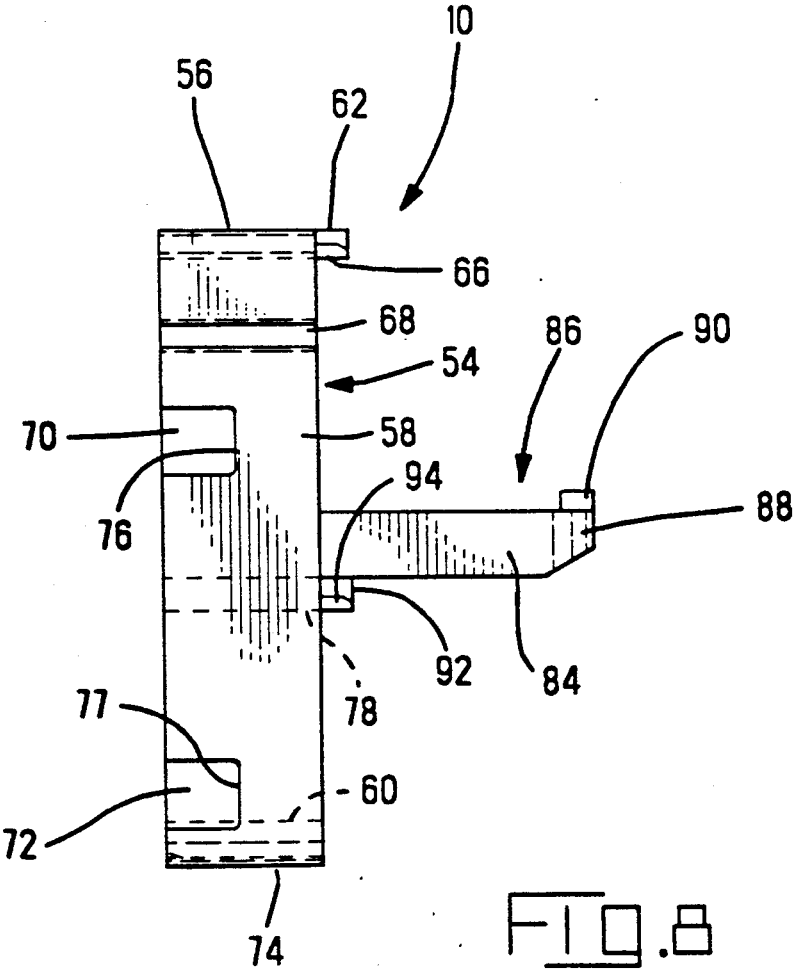
FIG. 8 is a side view of the support housing.

Each connector 2 and 4 is substantially in accordance with U.S. Pat. No. A-4,908,335 which is hereby incorporated by reference. Each housing 6 and 8 has a circular cross-section plug portion 14 for mating with a circular cross-section, externally shielded mating socket (not shown) from which project electrical pins. Each housing 6 and 8 has a central portion 16 from which the plug portion 14 projects (FIGS. 1 and 4). The plug portion 14 is formed with eight (in the present example) terminal receiving parallel cavities 18 extending axially therethrough, and opening into a mating face 19 of the portion 14, each cavity 18 having retained therein, an electrical socket terminal 20 for mating with a respective pin of the shielded mating socket which may be substantially in accordance with U.S. Pat. No. A-4,842,555 which is hereby incorporated herein by reference. The terminals 20 are substantially in accordance with the teaching of co-pending U.S. Pat. application Ser. No. 202,167 filed on June 3, 1988 which is hereby incorporated by reference. The central portion 16 has, projecting forwardly therefrom a hood 22 surrounding the plug portion 14 in spaced relationship thereto to allow the mating shielded socket to be mated with the plug portion 14. The central portion 16 has a terminal receiving face 24 opposite to the mating face 19, each cavity 18 opening into the face 24 as well as into the face 19. The plug portion 14 has axial keyways 26 for receiving keys on the mating socket. A protective skirt 28 projects rearwardly from the central portion 16. The hood 22 and the skirt 28 are formed on each side wall 30 of the housing with a common external groove 32 having a flared mouth 34 opening into the forward edge of the hood 22. Rearwardly, each groove 32 opens into the rear edge of the skirt 28. Each side wall 30 is formed with a latching shoulder 36 adjoined by a forward cam surface 37. The skirt 28 is formed with a central V-groove 38. There depends from the bottom of each side wall 30, a rib 39, the ribs 39 being parallel to one another and extending longitudinally of the housing.

The connectors 2 and 4 may differ from one another in the following respects. In housing 6 of the upper connector 2, the bottom wall 40 of the skirt 28 may be plane and uninterrupted; the bottom wall 42 of the skirt 28 of the housing 8 of the lower connector 4 is formed as a terminal leg spacer plate having four terminal leg receiving notches 44 configured according to the teaching of U.S. Pat. No. A-4,908,335, cited above.

Whereas each terminal 20 of the upper connector 2 has a rectangularly bent, long terminal leg 46 projecting beyond the bottom wall 40 of the skirt 28 and depending below the skirt 28 and terminating there below in a solder pin 48, each terminal 20 of the lower connector 4 has a rectangularly bent shorter terminal leg 50 projecting beyond the bottom wall 42 and extending downwardly through one of the notches 44, two of the legs 50 being received in each notch 44, and the solder pins 52 of the legs 50 terminating in the same horizontal plane as the solder pins 48, below the ribs 39 of the housing 8. The legs 46 and 50 are so connected to the terminals 20 according to the teaching of U.S. Pat. No. A-4,908,335 and Patent Application No. 202,167, both cited above, that the solder pins 48 and 52 of each set thereof extend in two rectilinear rows.

The connector support housing 10, which was molded in one piece from a suitable plastic material will now be described with particular reference to FIGS. 1 and 4, and 6 to 8. The housing 10 has a body 54 in the form of a substantially, rectangular vertically elongate, frame having a top wall 56, side walls 58 and a bottom wall 60. The top wall 56 is formed with a forwardly projecting, central, triangular, lug 62 opposite thereto, with a rearwardly opening notch 64 of similar configuration. There projects forwardly from the forward face of the wall 56, a rib 66 extending longitudinally thereof below the lug 62. Each side wall 58 is formed proximate to its upper end, with a transverse groove 68, the grooves 68 being in alignment with each other and each opening into both of the forward and the rear faces of the respective wall 58. Beneath the groove 68, each side wall 58 is formed with vertically spaced notches 70 and 72, respectively, the notch 70 being proximate to the groove 68 and the notch 72 being proximate to a rib 74 depending from the bottom face of the side wall 58. The notches 70 and 72 terminate in forward latching shoulders 76 and 77, respectively. Substantially, centrally of their height, the side walls 58 are spanned by a terminal leg spacer plate 78 having four rearwardly opening, terminal leg receiving, notches 80 similar to notches 44 in spacer plate 42. Notches 80 limit lateral movement of terminal legs received therein and provide a positive stop during insertion but do not have the V-grooves in the notch sidewalls for retention. The bottom wall 60, which provides a second terminal leg spacer plate is formed with four rearwardly opening notches 82 of the same configuration as the notches 44. An arm 84 of a connector support gantry 86 projects forwardly from the forward face of each sidewall 58, the arms 84 being connected by a cross-bar 88 at their ends remote from the body 54. On the upper surface of the cross-bar 88 is a connector retaining, central longitudinal rib 90. There projects from the forward face of the spacer plate 78, immediately below the gantry 86, a central triangular lug 92 and therebeneath, a central longitudinal rib 94.

The shield 12, which is stamped and formed from a single piece of sheet metal stock, will now be described with particular reference to FIGS. 1, 1A and 4. Some aspects of the shield 12 are in accordance with the teaching of U.S. Pat. No. A-4,482,554 cited above. The shield 12 comprises a top wall 96, a pair of side walls 98, each adjacent to the top wall 96 and depending from opposite lateral edges thereof and a front wall 100 adjacent to the walls 96 and 98. The front wall 100 has two spaced superposed, circular, through openings 102 substantially concentric with mating face 19 of plug portion 14, each for receiving a respective shielded socket for mating with a respective one of the plug portions 14. Through opening 102 has resilient cantilever fingers 103 extending from a peripheral edge thereof inwardly to within shield 12 and angularly toward plug portion 14 to engage shielding of a mated complementary connector. The shield 12 is open at its rear end and the bottom of the shield 12 is also open. The side walls 98 and the front wall 100 are equal in height to the height of the two connector housings 6 and 8 and the arms 84 of the gantry 86 of the housing 10. The stack height, or the center-to-center distance between the mating face of the plug portions 14 of the upper and lower connectors 2 and 4, can be varied by appropriately adjusting the thickness of arms 84. Each stack height of the subassembly of connectors 2 and 4 and housing 10 would have a shield sized to fit thereover.

There depend from opposite lateral edges of the top wall 96 near its rear end, tabs 104 each terminating in a downwardly directed flange 106, the flanges 106 projecting towards each other. Just below each flange 106, the respective side wall 98 is formed with a further inwardly directed flange 108 extending parallel to, and being contiguous with, the flange 106 thereabove. Each side wall 98 is further formed with upper forward and rear, inwardly struck detentes 110 and 112, and lower forward and rear inwardly struck detentes 114 and 116, the detentes of each pair being spaced from each other transversely of the respective side wall and parallel to the top wall 96. Each of these detentes is in the form of a resilient, tongue projecting obliquely inwardly of the shield 12. Each side wall 98 is further formed with an elongate, inwardly struck flange 118 between the upper detentes 110 and 112 and the lower detentes 114 and 116. For use in securing the shield 12 to a circuit board CB (FIG. 1A), mounting feet 120 depend from the side walls 98 and from the front wall 100.

Figure 3:
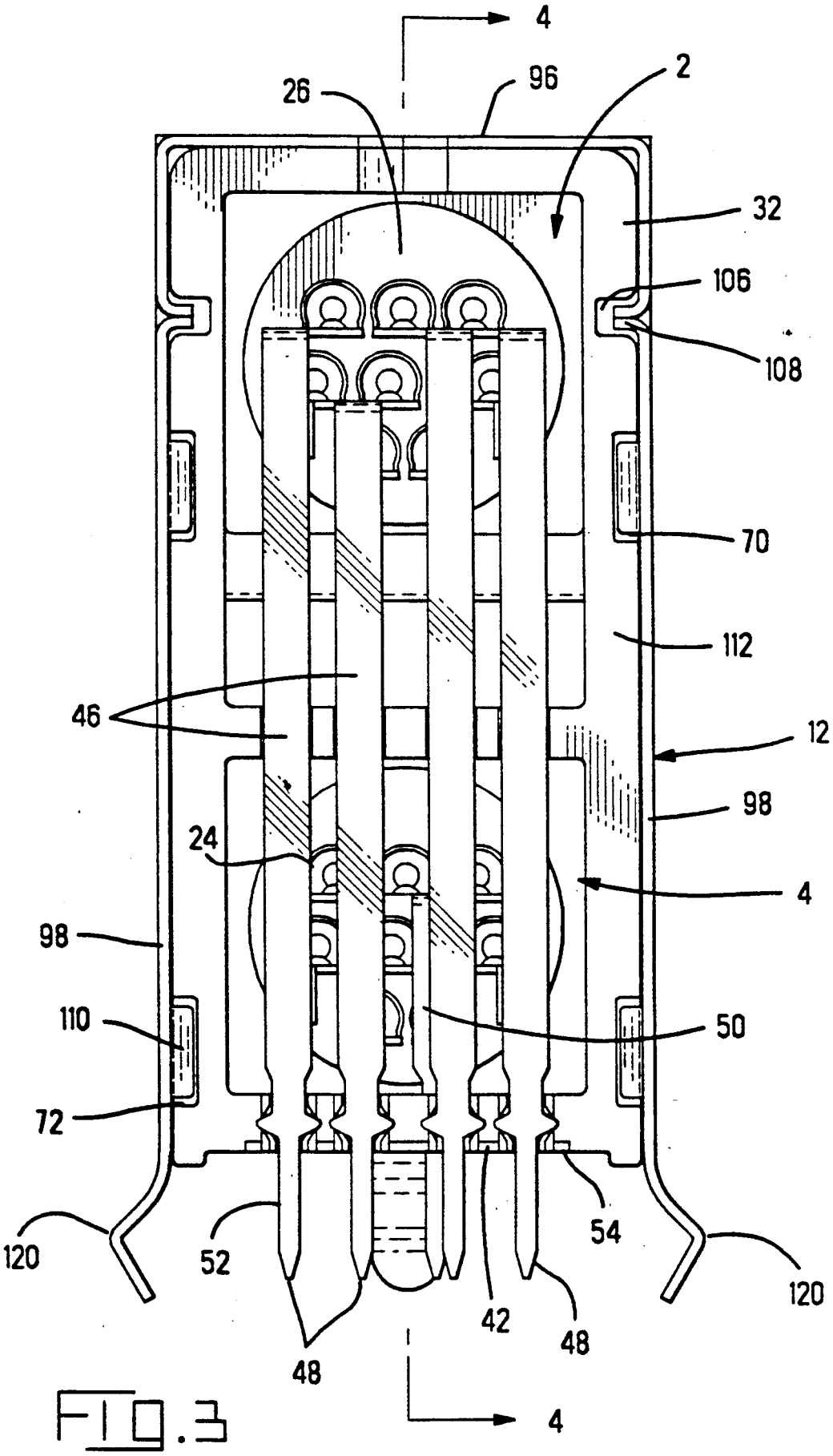
FIG. 3 is a rear end view of the assembly.

The parts of the assembly which have been described above, are assembled as follows. Initially, the cavities 18 of the housing 8 are loaded with terminals 20 by way of the terminal receiving face 24. Two of the legs 50 of these terminals are positioned in each slot 44 of the wall 42 as shown in FIG. 3. The housing 8 is then located beneath the gantry 86 of the support housing 10 with the lug 92 thereof engaged in the groove 38 of the housing 8 and rib 94 engaging beneath the top wall of the skirt 28 of the housing 8 as best seen in FIG. 4. The housing 6 is then placed on top of the gantry 86, with the edge of the bottom wall 40 of the skirt 28 of the housing 6 in abutment of the forward faces of the side walls 58 of the housing 10, so that the lug 62 thereof engages in the groove 38 of the top wall of the skirt 28 of the housing 6 and rib 66 engages beneath said top wall. Each rib 39 of the housing 6 now rests on a respective arm 84 of the gantry 86, the forward end portion of the end wall of the hood 22 of the housing 6 resting on the rib 90 of the cross-bar 88, as shown in FIG. 4. The aforesaid engagement of the lugs 62 and 92 and the ribs 66 and 94 of the support housing 10 with the connector housings 6 and 8, serves to position the housing 6 and 8 with respect to the housing 10 and to hold the housings in their relative positions as the assembly operation proceeds.

The housing 6 is now loaded with terminals 20 so that, as shown in FIGS. 3 and 4, two legs 46 of these terminals are received in each notch 80 of the spacer plate 78 of the housing 10 and in each notch 82 of the bottom wall 60 of the housing 10. The legs 46 and 50 are, as mentioned above, such that the tips of the solder pins 48 and 52 all lie in the same horizontal plane.

Finally, the shield 12 is slid over the subassembly of connectors 2 and 4 which have been assembled to the support housing 10 as described above. As the shield is being assembled to the connectors 2 and 4 and to the support housing 10, each pair of contiguous flanges 106 and 108 of the shield 12 enters a respective groove 32 of the upper housing 6, by way of the mouth 34 of the groove 32 and slides therealong into the groove 68 which is aligned with that groove 32, so that the pair of flanges 106 and 108 lie in both of these grooves as will be apparent from FIG. 2, each flange 118 of the shield 12 entering the groove 32 of the lower housing 8 by way of the mouth of that groove. Further, during the assembly of the shield 12 into a home a position about the connectors 2 and 4 and the support housing 10, each detente 112 rides up the respective cam surface of the housing 6 and over the adjacent shoulder 36 then up the respective cam surface of the housing 10 and latches behind the latching shoulder 76 of the housing 10, each detente 110 riding up the respective cam surface 37 of the housing 6 and latching behind the latching shoulder 36 thereof. Similarly, each detente 116 rides up a respective cam surface 37 of the housing 8, over the adjacent shoulder 36, then up the respective cam surface of the housing 10 and latches behind the respective latching shoulder 77 of the housing 10 each detente 114 riding up the respective cam surface 37 of housing 8 and latching behind the latching shoulder 36 thereof.

As will be apparent from the above description, in the final position of the shield 12 on the housings, the engagement of the detentes 110, 112, 114 and 116 against their respective latching shoulders 36, 76 and 77, securely fixes the connectors 2 and 4 and the support housing 10, together, and against withdrawal from the shield 12 in the axial direction. The engagement of the flanges 106, 108 and 118 in their respective grooves 32 and 68 secures the connectors 2 and 4 and the housing 10 together against withdrawal through the open bottom of the shield 12, the detentes 110, 112, 114 and 116 also assisting in this regard. The completed assembly is thus a unitary and rigid structure which can be handled without any risk of its disintegration.

Figure 1A:
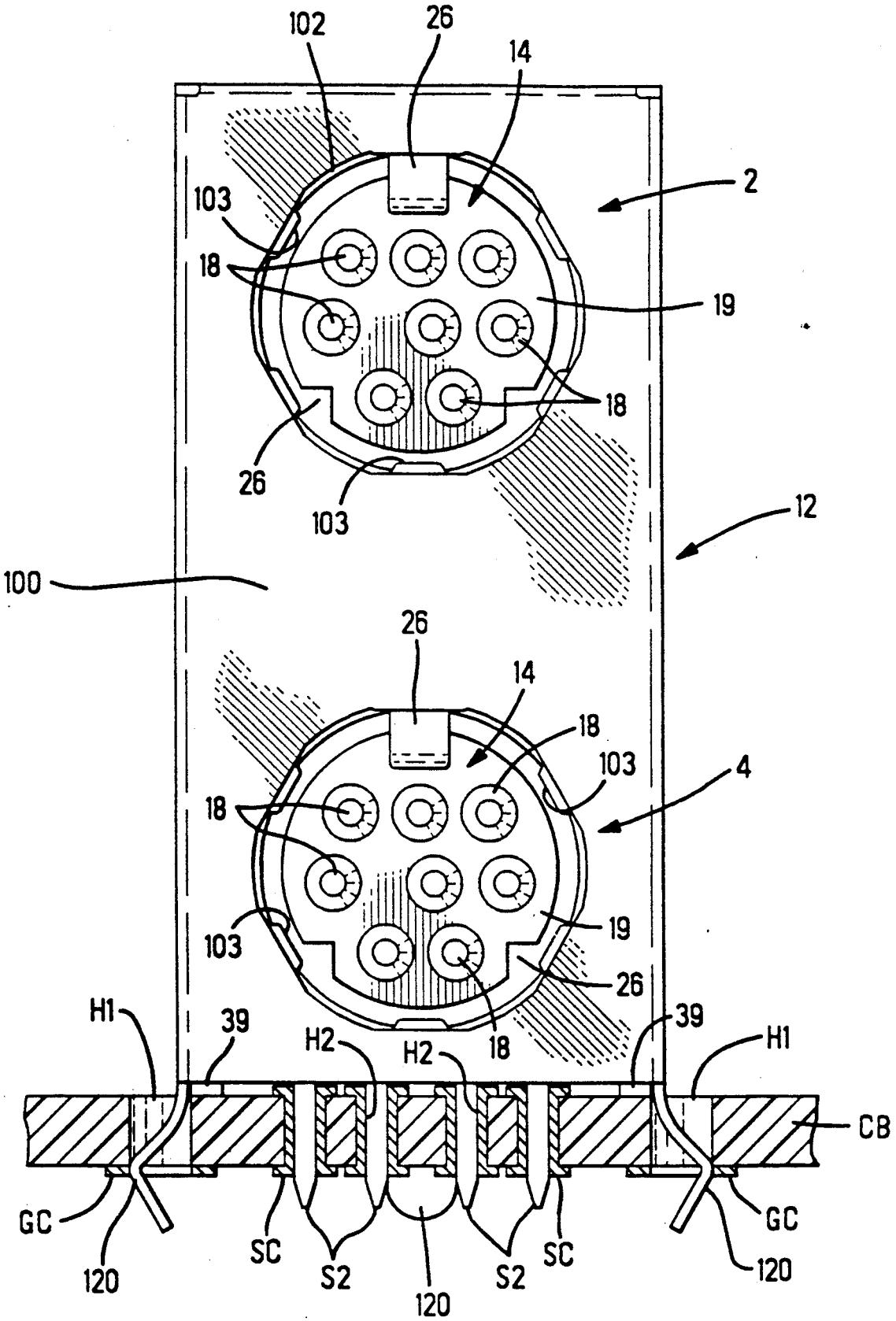
FIG. 1A is a front view of the assembly when mounted to a circuit board.
Figure 2:
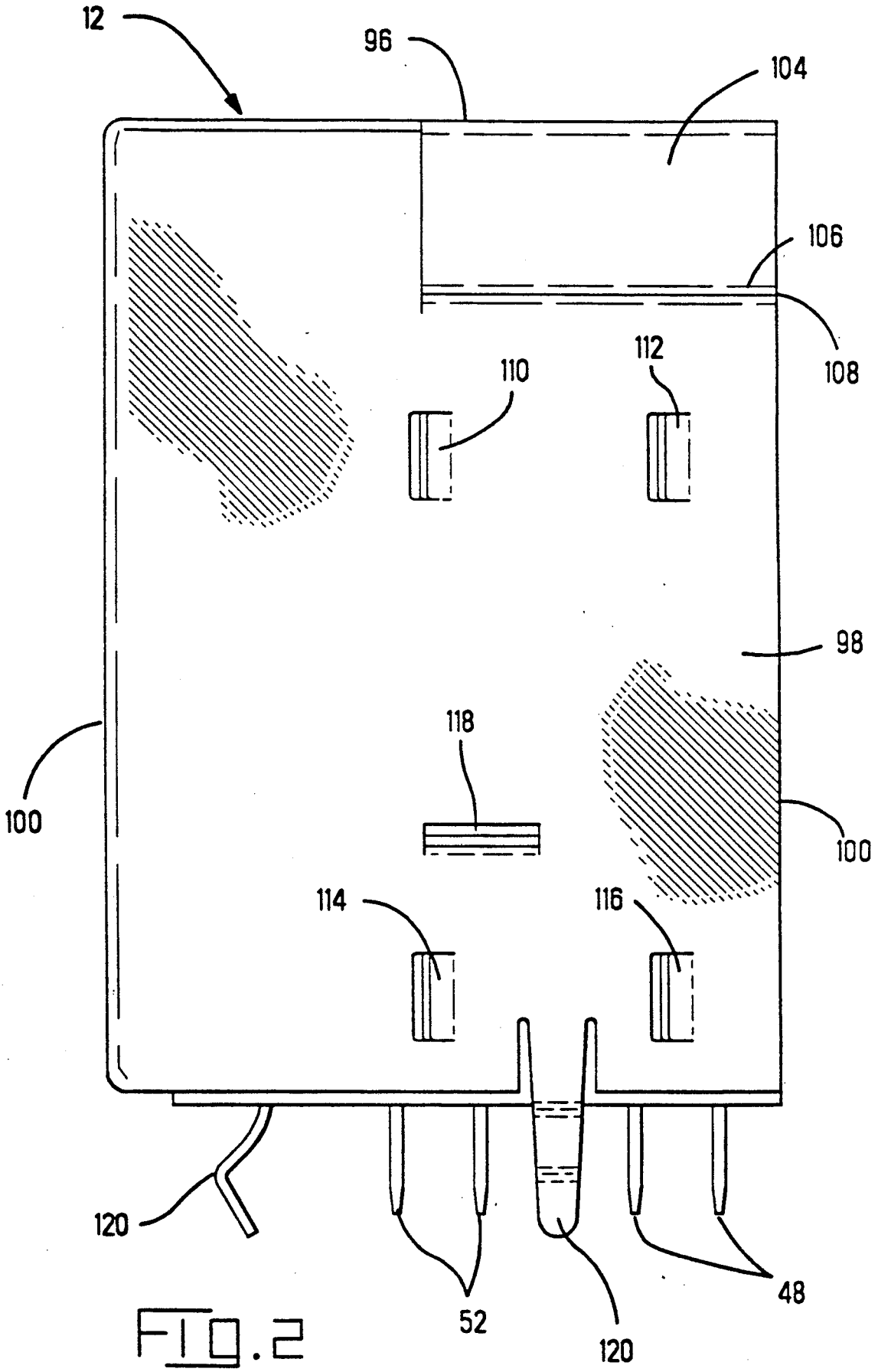
FIG. 2 is a side view of the assembly.

In use, the completed assembly is mounted to the circuit board CB as shown in FIG. 1A with the mounting feet 120 extending through first holes H1 in the board CB and engaging grounding conductors GC thereon and the solder pins 48 and 52 extending through second holes H2 in the board CB and through signal conductors SC thereon. The pins 48 and 52 and the mounting feet 120 are then soldered to their respective conductors.

The shield 12 provides shielding for the top and both sides of the assembled connectors 2 and 4 and is grounded to the conductors GC. The shield 12 also provides interface with the shielding of the shielding plugs when these have been mated with the connectors 2 and 4 shield 12 provides a conductive path to a common ground for shielded complementary connectors mated to connectors 2 and 4.

The stacking of the connectors 2 and 4 reduces the circuit board frontage needed to mount them on the circuit board.

The support 10 may be used with connectors of the same kind as the connectors 2 and 4, but having less than eight terminal positions for example three terminal positions.

The spacing between the upper and lower connectors can be selected by appropriately dimensioning the arms of the support housing.

The assembly described above is produced without the aid of screws or other separate fastening means.

What is claimed is:

1. A shielded, stacked electrical connector assembly, comprising;

upper and lower electrical connectors each having a substantially rectangular insulating housing having a mating face, a terminal receiving face opposite to the mating face, a top face and a bottom face, each housing defining a plurality of terminal receiving cavities opening into both the mating face and the terminal receiving face of the housing;

a plurality of electrical terminals retained in the cavities of each housing, each terminal having a mating portion proximate to the mating face of the housing and a terminal leg extending from the terminal receiving face of the housing;

a one piece, insulating, connector support housing, comprising an upright frame having a top wall, a bottom wall, and opposite side walls connecting said top and bottom walls, and a connector support supporting the upper connector and projecting horizontally from the frame between the bottom face of the upper connector and top face of the lower connector;

a one piece metal shield having a top wall enclosing the top face of the upper connector and the top wall of the connector support housing, a front wall apertured for receiving means for mating with the mating portions of said terminals and extending proximate to the mating faces of the housings, opposite side walls enclosing side walls of the upper and lower connectors and the side walls of the connector support housing and detente means on said shield engaging the housings of the connectors and the connector support housing, to secure these housing in the shield, thereby to provide a unitary and rigid stacked electrical connector assembly.

2. An assembly as recited in claim 1, wherein the frame further comprises a plurality of terminal leg spacer plates spanning the side walls of the frame in vertically spaced relationship and defining openings receiving the terminal legs of the terminals of the upper connector, the terminal legs of the upper connector terminating below the bottom face of the upright frame and the terminal legs of the terminals of the lower connector terminating below the bottom face of the lower connector.

3. An assembly as recited in claim 1, wherein said detente means comprise first, second and third pairs of detentes struck from the side walls of the shield, the first detentes engaging latching shoulders on the side walls of the housing of the upper connector, the second detentes engaging the first latching shoulders on the side walls of the upright frame, the third detentes engaging latching shoulders on the side walls of the housing of the lower connector and the fourth detentes engaging second latching shoulders on the side walls of the upright frame.

4. An assembly as recited in claim 1, wherein first and second pairs of flanges project inwardly from the side walls of the shield, the flanges of the first pair engaging in grooves in the side walls of the housing of the upper connector and in grooves in the side walls of the upright frame and the flanges of the second pair engaging in grooves in the side walls of the housing of the lower connector, all of said grooves extending horizontally.

5. An assembly as recited in claim 1, wherein said connector support comprises a pair of arms each projecting from a forward face of a respective one of the side walls of the upright frame, a cross-bar spanning the arms and having a first rib projecting upwardly from the cross-bar and therealong, each side wall of the housing of the upper connector having a second rib depending therefrom and resting upon a respective one of the arms, and the bottom face of the housing of the upper connector resting on said first rib.

6. An assembly as recited in claim 1, wherein the top wall of the upright frame has a first triangular shaped lug engaging in a complementary notch in a proximate edge of the top face of the housing of the upper connector and a first rib beneath said lug and engaging beneath the top face of the housing of the upper connector, a wall spanning the side walls of the upright frame having a second triangular lug engaged in a complementary notch in a proximate edge of the top face of the housing of the lower connector and a second rib beneath said second lug and engaging beneath the top face of the housing of the lower connector.

7. A shielded, stacked electrical connector assembly, comprising;

upper and lower superposed electrical connectors each having a substantially rectangular cross-section body having an annular recess in which projects forwardly, a circular cross-section plug portion for mating with a circular cross-section externally shielded electrical socket, a one piece insulating, connector support housing having a connector support projecting horizontally therefrom and supporting the upper connector, and a one piece metal shield, the lower connector being arranged beneath the connector support and the shield having anchoring means engaging the housing and thereby retaining these housings within the shield, the shield being apertured to allow a respective externally shielded electrical socket to be mated with the plug portion of each connector.

8. A shielded, stacked electrical connector assembly as recited in claim 7, wherein the spacing between the upper and lower superposed connectors is determined by a vertical thickness of the connector support.

9. A one piece, insulating, electrical connector support housing for use in stacking electrical connectors in a shielded, stacked electrical connector assembly, the support housing comprising a substantially rectangular frame defined by a top wall, a bottom wall and a pair of spaced elongate side walls connecting said top and bottom walls, each side wall having a forward and a rear face, a connector support projecting from the forward faces of said side walls substantially normally thereof and substantially midway between said top and bottom walls, a pair of parallel, terminal leg spacer plates spanning said side walls in spaced relationship longitudinally thereof and each spacer plate having a plurality of terminal leg receiving notches opening rearwardly of said frame, a first latching shoulder being provided on each side wall, above said connector support and a second latching shoulder being provided on each side wall, below said connector support, each latching shoulder being for latching engagement with a respective detente on a metal shield for shielding said connectors.

10. A connector support housing as recited in claim 9, wherein the connector support comprises an arm projecting from the forward face of each side wall and a cross-bar spanning the arms projecting from the forward face of each side wall and a cross-bar spanning the arms at ends thereof remote from the forward faces of said side walls, the cross-bar having an upper face and a rib thereon extending along the cross bar.

11. A connector support housing as recited in claim 10, wherein a first triangular shaped lug projects from a forward face of the top wall of the frame, a first rib extending along that forward face and beneath the first lug, a second triangular shaped lug projecting from a forward edge of one of the spacer plates, below the connector support and a second rib extending along that forward edge and below the second lug.

12. A connector support housing as recited in claim 9, wherein each side wall of the frame formed with a groove opening into both the forward and the rear faces of that side wall, above the connector support, the grooves being aligned with each other in parallel relationship.

13. A one piece metal shield for upper and lower superposed, stacked electrical connectors each having a substantially rectangular cross-section body having an annular recess within which projects a circular cross-section plug portion for mating with a circular cross-section, externally shielded electrical socket, said shield comprising;

a top wall for enclosing substantially the entirety of a top wall of the body of the upper connector;

a pair of shielded side walls, each adjacent to the shield top wall for enclosing substantially the entirety of opposite side walls of the bodies of both the upper and the lower connectors; and a shield front wall adjacent to the shield top wall and to the shield side walls, said shield front wall having two substantially circular openings therein each for receiving a respective socket for mating with a respective one of said plug portions; whereby the shield is adapted to provide shielding for substantially the entirety of said stacked connectors.

14. A one piece metal shield as recited in claim 13, wherein each shield side wall provided with first and second aligned detentes spaced from each other in a direction parallel to said shield top wall and proximate thereto, the first detente being for engaging a latching shoulder on a respective side wall of the upper connector and the second detente being for engaging a latching shoulder on a housing supporting the upper connector, each shield side wall being further provided with third and fourth detentes spaced from each other in a direction parallel to said shield top wall but being remote therefrom, the third detente being for engagement with a latching shoulder on a respective side wall of the lower connector and the fourth detente being for engagement with a further latching shoulder on said support housing.

15. A one piece metal shield as recited in claim 13, wherein each shield side wall is formed with first flange means proximate to said shield top wall and extending parallel thereto said flange means projecting towards one another inwardly of said shield for engagement in grooves in the side walls of the upper connector and grooves in the side walls of a support housing supporting said upper connector and grooves in the side walls of a support housing supporting said upper connector, each side wall being further provided with second flange means extending parallel to said shield top wall and being remote therefrom, the second flange means projecting towards one another inwardly of the shield for engagement in respective grooves in the side walls of the lower connector.

* * * * *

UNITED STATES PATENT AND TRADEMARK OFFICE

CERTIFICATE OF CORRECTION

PATENT NO. : 5,037,330

DATED : August 6, 1991

INVENTOR(S) : John A. Fulponi et al

It is certified that error appears in the above-identified patent and that said Letters Patent is hereby corrected as shown below:

On the title page item [73] Assignee: change the name of the Assignee from "AMP Corporated" to --AMP Incorporated--.

Signed and Sealed this

Seventeenth Day of March, 1992

*Attest:*

HARRY F. MANBECK, JR.

*Attesting Officer*

*Commissioner of Patents and Trademarks*